US009797647B2

(12) United States Patent
Görz et al.

(10) Patent No.: US 9,797,647 B2
(45) Date of Patent: Oct. 24, 2017

(54) DOMESTIC REFRIGERATOR WITH SEPARATELY ATTACHABLE DIVISIONAL WALL HAVING AIR CHANNELS

(75) Inventors: Alexander Görz, Aalen (DE); Jicong Song, Jiangsu (CN)

(73) Assignee: BSH HAUSGERÄTE GMBH, Munich (DE)

( * ) Notice: Subject to any disclaimer, the term of this patent is extended or adjusted under 35 U.S.C. 154(b) by 520 days.

(21) Appl. No.: 14/345,760

(22) PCT Filed: Sep. 11, 2012

(86) PCT No.: PCT/IB2012/054714
§ 371 (c)(1),
(2), (4) Date: Oct. 9, 2014

(87) PCT Pub. No.: WO2013/042010
PCT Pub. Date: Mar. 28, 2013

(65) Prior Publication Data

US 2015/0040605 A1 Feb. 12, 2015

(30) Foreign Application Priority Data

Sep. 19, 2011 (CN) ..... 2011 1 0288442

(51) Int. Cl.
*F25D 17/04* (2006.01)
*F25D 17/06* (2006.01)
(Continued)

(52) U.S. Cl.
CPC ..... *F25D 17/065* (2013.01); *F25D 17/04* (2013.01); *F25D 23/069* (2013.01); *F25D 11/00* (2013.01);
(Continued)

(58) Field of Classification Search
CPC .... F25D 17/065; F25D 23/061; F25D 23/069; F25D 17/067; F25D 11/00; F25D 11/025
See application file for complete search history.

(56) References Cited

U.S. PATENT DOCUMENTS 4,550,576 A 11/1985 Tate et al.
5,577,822 A * 11/1996 Seon ..... F25D 17/065 312/401
(Continued)

FOREIGN PATENT DOCUMENTS

DE 38 43 287 6/1990
JP 2003-262459 9/2003
(Continued)

OTHER PUBLICATIONS

International Search Report issued for PCT/162012/054714, mailed Oct. 17, 2013.
(Continued)

*Primary Examiner* — David Teitelbaum
(74) *Attorney, Agent, or Firm* — Nixon & Vanderhye, P.C.

(57) ABSTRACT

A domestic refrigerator (1) comprises a thermally insulated housing (2), a cold storage compartment (5) and a fresh food compartment (4) contained within the housing (2) and located on top of each other, a refrigerant circuit which comprises an evaporator (29) configured to directly cool the cold storage compartment (5), a first door leaf (18) for closing and opening the fresh food compartment (4), a second door leaf (19) for closing and opening the cold storage compartment (5), a divisional wall (17, 42) separating the cold storage compartment (5) from the fresh food compartment (5), and a air channel system (31, 32) which is
(Continued)

Figure 1:
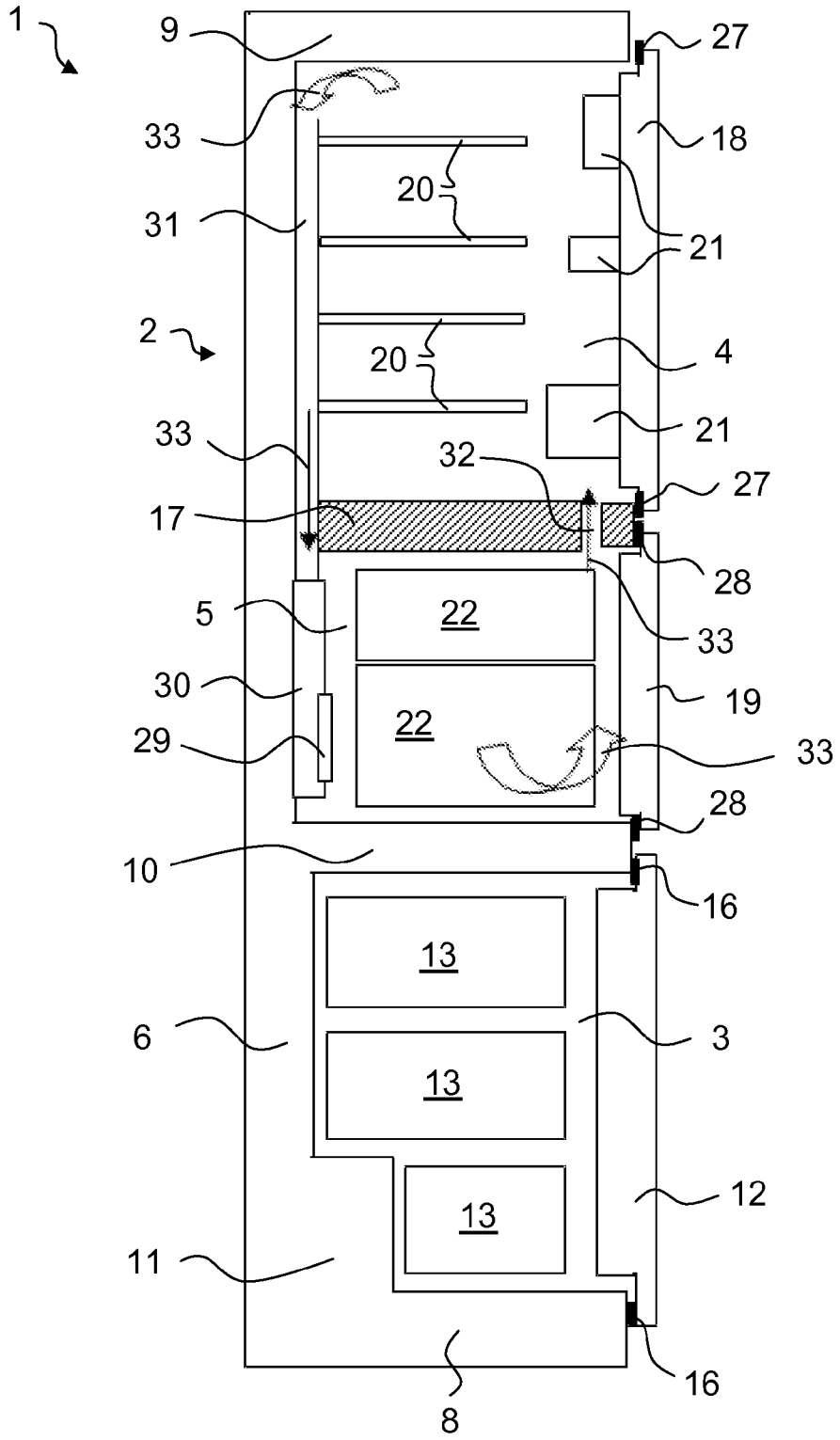

configured to allow an air exchange between the cold storage compartment (5) and the fresh food compartment (4).

18 Claims, 6 Drawing Sheets

(51) Int. Cl.
*F25D 11/02* (2006.01)
*F25D 23/06* (2006.01)
*F25D 11/00* (2006.01)
*F25D 23/08* (2006.01)

(52) U.S. Cl.
CPC ..... *F25D 11/025* (2013.01); *F25D 17/067* (2013.01); *F25D 23/061* (2013.01); *F25D 23/087* (2013.01); *F25D 2317/0653* (2013.01); *F25D 2317/0663* (2013.01); *F25D 2317/0667* (2013.01)

(56) References Cited

U.S. PATENT DOCUMENTS 5,839,287 A * 11/1998 Stormo ..... F25D 17/065 62/407
5,899,083 A 5/1999 Peterson et al.
6,290,314 B1 * 9/2001 Kim ..... F25D 23/069 312/296
6,422,673 B1 * 7/2002 Bienick ..... F25D 25/024 312/351
2004/0172964 A1 * 9/2004 Brachert ..... F25D 23/069 62/407
2007/0033960 A1 * 2/2007 Egan ..... F25D 23/02 62/389
2008/0016889 A1 * 1/2008 Jung ..... F25D 17/045 62/187
2008/0155994 A1 * 7/2008 Miyamoto ..... F25D 11/02 62/6
2009/0056364 A1 3/2009 Görz et al.
2010/0275639 A1 * 11/2010 Jendrusch ..... F25D 17/065 62/407

FOREIGN PATENT DOCUMENTS

JP 2005-134043 5/2005
RU 2395761 C2 7/2010
WO WO 2005/068921 7/2005

OTHER PUBLICATIONS

Written Opinion of the International Searching Authority PCT/IB2012/054714, mailed Oct. 17, 2013.

* cited by examiner

DOMESTIC REFRIGERATOR WITH SEPARATELY ATTACHABLE DIVISIONAL WALL HAVING AIR CHANNELS

This application is the U.S. national phase of International Application No. PCT/IB2012/054714, filed 11 Sep. 2012, which designated the U.S. and claims priority to CN Application No. 201110288442.7, filed 19 Sep. 2011, the entire contents of each of which are hereby incorporated by reference.

The invention relates to a domestic refrigerator.

Conventional domestic refrigerators usually comprise a thermally insulated housing. They may also comprise a cold storage compartment and a fresh food compartment contained within the housing and located on top of each other. The cold storage compartment is intended to provide non-freezing temperatures around 0° C., particularly in the range between 0° C. and 3° C. The fresh food compartment is intended to provide non-freezing temperatures at a greater temperature than that of the cold storage compartment, particularly about +3° C. to +8° C.

The object of the invention is to provide a further domestic refrigerator which comprises a thermally insulated housing, and a cold storage compartment and a fresh food compartment contained within the housing and located on top of each other.

The object of the invention is achieved by means of a domestic refrigerator, comprising a thermally insulated housing, a cold storage compartment and a fresh food compartment contained within the housing and located on top of each other, a refrigerant circuit which comprises an evaporator configured to directly cool the cold storage compartment, a first door leaf for closing and opening the fresh food compartment, a second door leaf for closing and opening the cold storage compartment, a divisional wall separating the cold storage compartment from the fresh food compartment, and an air channel system which is configured to allow an air exchange between the cold storage compartment and the fresh food compartment.

The inventive refrigerator comprises the thermally insulated housing, which particularly comprises a rear wall and two side walls, and the two compartments, namely the cold storage and the fresh food compartment. The cold storage compartment is intended to provide non-freezing temperatures around 0° C., particularly in the range between 0° C. and 3° C. The fresh food compartment is intended to provide non-freezing temperatures at a greater temperature than that of the cold storage compartment, particularly about +3° C. to +8° C. Additionally, the inventive refrigerator comprises two door leafs, one for the cold storage and one for the fresh food compartment. Thus, each compartment can be accessed individually. The door leafs are preferably thermally insulating.

The two compartments are separated by the divisional wall, which preferably is a thermally insulated divisional wall.

The inventive refrigerator comprises a single refrigerant circuit for both compartments. Particularly, only the cold storage compartment is directly cooled by the evaporator of the refrigerant circuit. This may be achieved by placing the evaporator into the cold storage compartment, for instance, by attaching the evaporator to the rear wall of the housing. It is also possible to dispose the evaporator within a dedicated housing which is coupled, for instance, to the cold storage compartment by an air channel. There may also be at least one fan provided configured to convey air cooled by the evaporator to the cold storage compartment. A single refrigerant circuit for both compartments results in decreased costs of the inventive refrigerator.

Since only the cold storage compartment is directly cooled by the evaporator, the inventive refrigerator comprises the air channel system allowing an air exchange between the cold storage compartment and the fresh food compartment. Thus, the fresh food compartment can be indirectly cooled through the cold storage compartment.

In order to achieve improved thermal insulation of at least one of the compartments from the surrounding space of the inventive refrigerator, at least one of the door leafs may comprise a magnetic gasket attached on the surface facing towards the cold storage or fresh food compartment. Then, an edge of the divisional wall facing away from the cold storage and fresh food compartments comprises or is made at least partly from a metal.

The door leafs may be hinged relative to the housing by hinges. At least one of the hinges may then be at least partly attached to the edge of the divisional wall facing away from the cold storage and fresh food compartments.

In one embodiment of the inventive refrigerator, the divisional wall or at least a main part of the divisional wall is inserted into and attached to the housing. Thus, the divisional wall of this embodiment is not a structural or integral part of the housing. Therefore, it is possible to manufacture the housing without the divisional wall, for instance, by utilizing a well known foaming process. This allows the housing to be produced more easily than a housing with a divisional wall, which is an integral part of this housing.

In order to attach the divisional wall or at least the main part of the divisional wall to the housing, latching devices may be utilized.

In one embodiment of the inventive refrigerator, the divisional wall or at least the main part of the divisional wall can only be detached from the housing by an appropriate tool. This ensures that a user of the inventive refrigerator cannot remove the divisional wall or at least the main part of the divisional from the housing. This embodiment is, for instance, beneficial, if hinges for the door leafs are at least partly be attached to the divisional wall.

In another embodiment of the inventive refrigerator, the divisional wall or at least the main part of the divisional wall can be detached from the housing without any appropriate tools. Then, a user of the inventive refrigerator can remove the divisional wall or at least the main part of the divisional wall, for instance, to better clean it.

In one embodiment of the inventive refrigerator, the divisional wall comprises the main part, which is inserted into and attached to the housing, and a traverse which is rigidly fixed to and at the front side of the housing, and runs between the side walls of the housing. The traverse is an integral part of the housing and is, for instance, assembled before foaming the housing. This embodiment may improve stability of the refrigerator, particularly if the hinges for the door leafs are at least partly attached to the traverse. For this embodiment, it may be beneficial for the main part of the divisional wall to be able to be detached from the housing without any appropriate tools. Then, a user of the inventive refrigerator can remove the main part of the divisional wall, for instance, to better clean it.

At least one of the hinges may be at least partly attached to the edge of the traverse facing away from the cold storage and fresh food compartments.

In one embodiment of the inventive refrigerator, the divisional wall or at least the main part of the divisional wall comprises at least one aperture or air channel which forms at least a part of the air channel system. Such an aperture or air channel can be made relatively easily. If the divisional wall comprises the main part, which is inserted into and attached to the housing, and a traverse which is rigidly fixed to and at the front side of the housing, and runs between the side walls of the housing, then this air channel may be formed by a gap between the main part and the traverses of the divisional wall.

The at least one aperture or air channel may be located preferably near the front of the refrigerator, may essentially extend about the entire width of the divisional wall, and/or may run parallel to the rear wall of the housing.

The air channel system of the inventive refrigerator may also comprise a further channel which connects the cold storage compartment with the fresh food compartment. Then, In one embodiment of the inventive refrigerator, the divisional wall comprises the main part, which is inserted into and attached to the housing, and a traverse which is rigidly fixed to and at the front side of the housing, and runs between the side walls of the cold air from the cold storage compartment can flow to the fresh food compartment preferably through the air channel or aperture, and air from the fresh food compartment back to the cold storage compartment through the further air channel.

The further air channel may be located inside the rear wall of the housing. The further air channel may be attached to the surface of the rear wall of the housing facing towards the cold storage and fresh food compartments. This may help reduce costs when manufacturing the inventive refrigerator. The further air channel may also be formed by a gap between the divisional wall and the surface of the rear wall of the housing facing towards the cold storage and fresh food compartments. This variant can relatively easily be realized.

The fresh food compartment may be located on top of the cold storage compartment. Then, the further air channel may extend to at least half of the height of the fresh food compartment. Preferably, the further air channel may extend almost to the ceiling of the fresh food compartment.

In order to improve stability of the divisional wall, it may comprise at least one reinforcement component. For improved insulation, the divisional wall may comprise a thermally insulating part or may be made from a thermally insulating material.

The divisional wall, particularly the traverse may also include a heating system, for instance, comprised of a heating tube. The heating system is preferably intended to at least reduce the risk of generated dew. The heating tube particularly may be a hot gas tube connected to the refrigerant circuit.

Depending on the embodiment of the inventive refrigerator, the refrigerator provides a divisional wall, which can be assembled or attached to the cabinet or housing after a foaming process used to manufacture the housing or cabinet. The divisional wall can even be attached to the housing after the cooling system, i.e. the refrigerant circuit, is attached to the housing.

Preferably, the divisional wall comprises at least a part of the air channel system provided for air exchange between the cold storage and the fresh food compartment.

Depending on the embodiment, the divisional wall may comprise one or more of the following:

A sheet metal front traverse which may provide sufficient stability for applying the door leaf hinge, if applicable, and a metallic contact for a door leaf magnetic gasket.

At least one reinforcement component, such as a metal stamping part, to act as stabilizing reinforcements for connecting the door hinges.

An upper plastic injection molded part which forms the visible and touchable top surface of the divisional wall and may be the bottom area of one of the compartments. At this plastic component, means to form at least a part of the air channel system toward the lower surface of the divisional wall may be provided.

A lower plastic injection molded part which forms the visible and touchable bottom surface of the divisional wall and may be the ceiling area of the other compartment. At this plastic component, means to form at least a part of the air channel system towards the upper surface of the divisional wall are provided.

An insulation part, for instance, made from extended polystyrene or foam material, resulting in an enhanced thermal insulation between the upper and lower surface of the divisional wall. This may also result in a structural support to strengthen the mechanical properties of the divisional wall.

If applicable, the upper and lower plastic injection molded parts may be designed in such a way that there is at least a part of the air channel system relatively close behind the metallic front surface, for instance, the traverse. The actual position of this "door side air channel" can be designed in such a way that the (central) traverse is not directly affected by a cold air stream, in order to avoid or at least mitigate condensation effects at the metallic surface.

Alternatively, the divisional wall may comprise two parts: a "front deck" part, the traverse, which is assembled before foaming the housing or cabinet, and a main part which is assembled afterwards, i.e. inserted and attached to the housing. In such a design, most of the advantages are achieved, however, it is possible to integrate a frontside frame-heater-tubing (hot gas heater) to the front deck, in order to prevent or at least mitigate condensation effects to the central traverse.

Depending on the embodiment of the inventive refrigerator, it provides one or more of the following advantages:

If the divisional wall or at least a main part of the divisional wall is inserted into and attached to the housing, then assembling of the inventive refrigerator is easier. For instance, the foaming process of the housing or cabinet may not be affected by the divisional wall. In addition, the divisional wall can be made thinner than the walls of the housing. The divisional wall can be assembled at a relatively late stage of the assembling process, for instance, even after the cooling system was attached to the refrigerator, potentially reducing costs for assembling the refrigerator and/or potentially improving production quality. The inner liner of the housing or cabinet can be made to have a less complicated structure compared with an embodiment for which the divisional wall is an integrated part of the housing. This results in a less complicated thermoforming process of the inner liner and makes it possible to reduce the thickness of walls, potentially reducing the amount of material needed. This may reduce costs.

If the divisional wall is removable, i.e. detachably attached to the housing, then it is possible for an appliance customer service personnel to remove the divisional wall, for instance, to perform maintenance or repair a faulty refrigerator. In particular, this may help the appliance customer service personnel to better reach the cooling system.

The foaming process of the housing or cabinet may not be affected by the air channel system.

Figure 2:
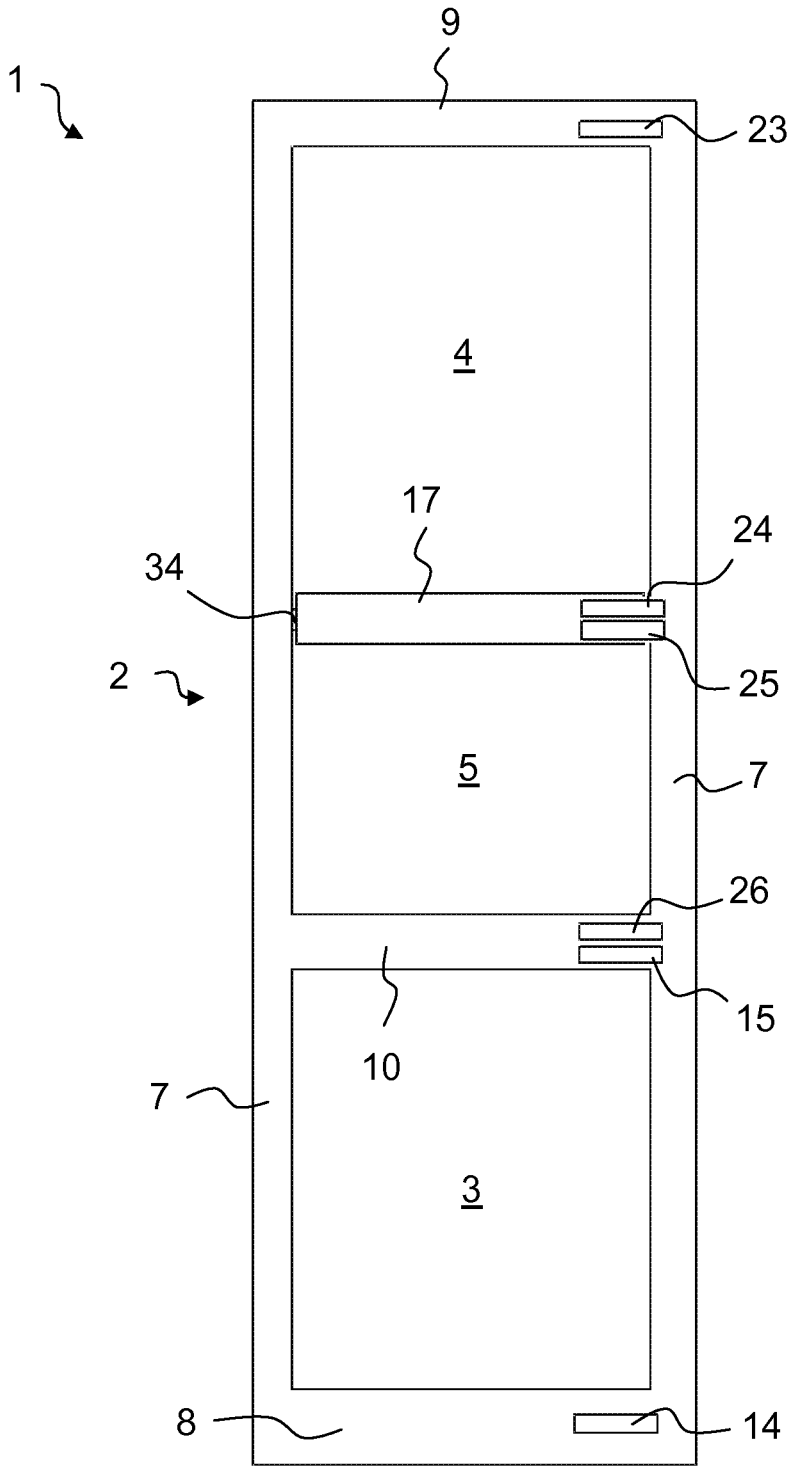
Figure 3:
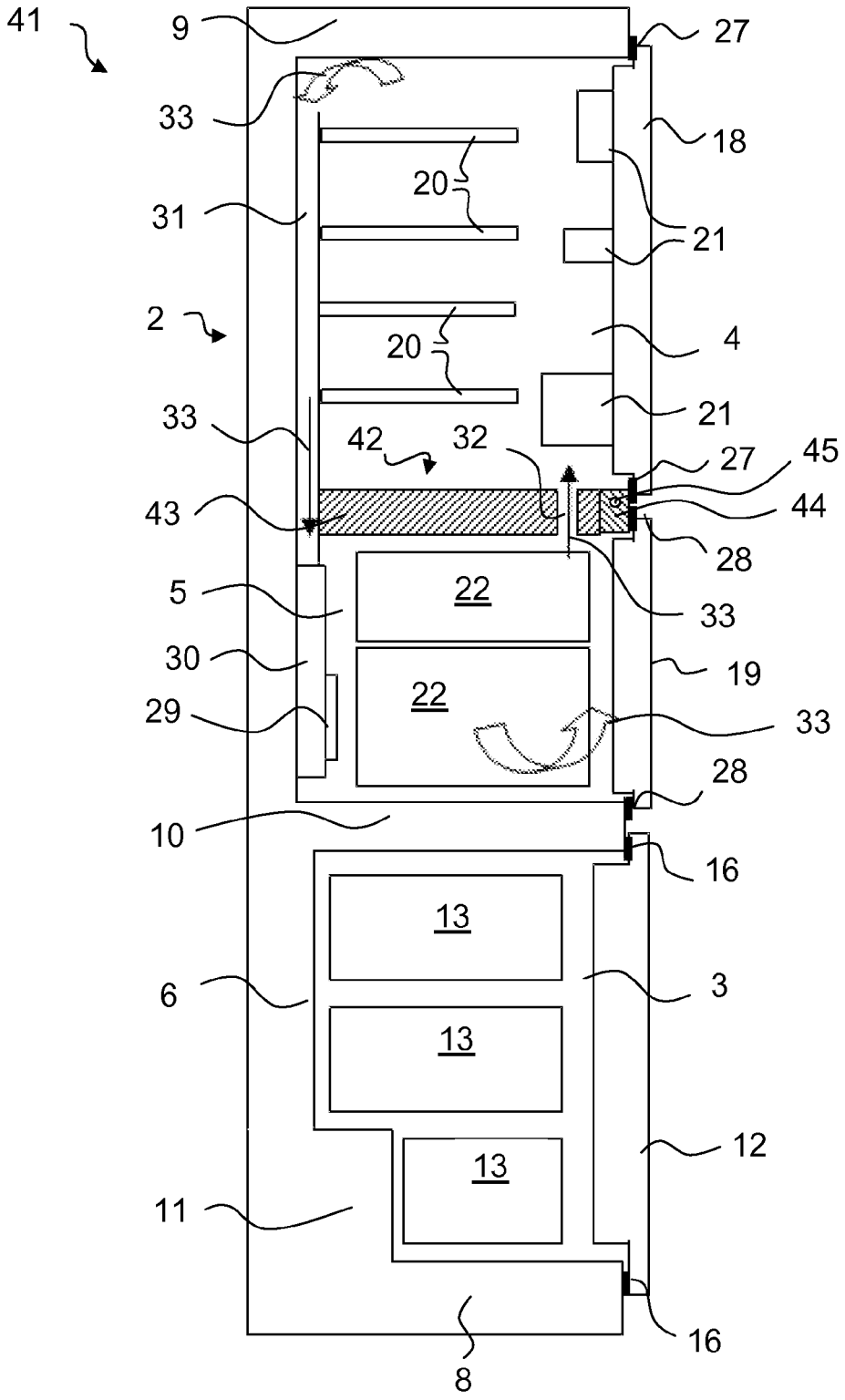
Figure 4:
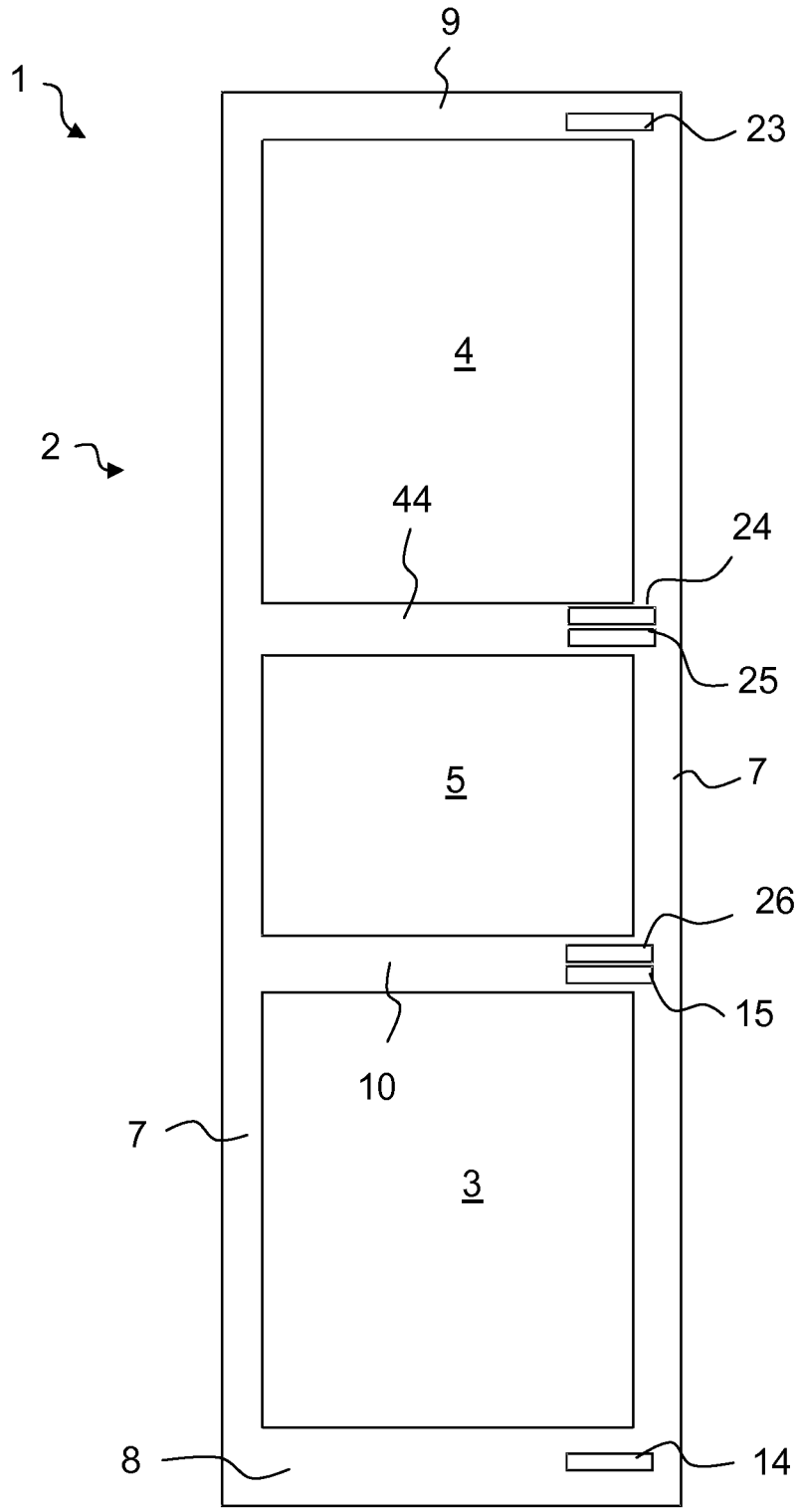
Figure 5:
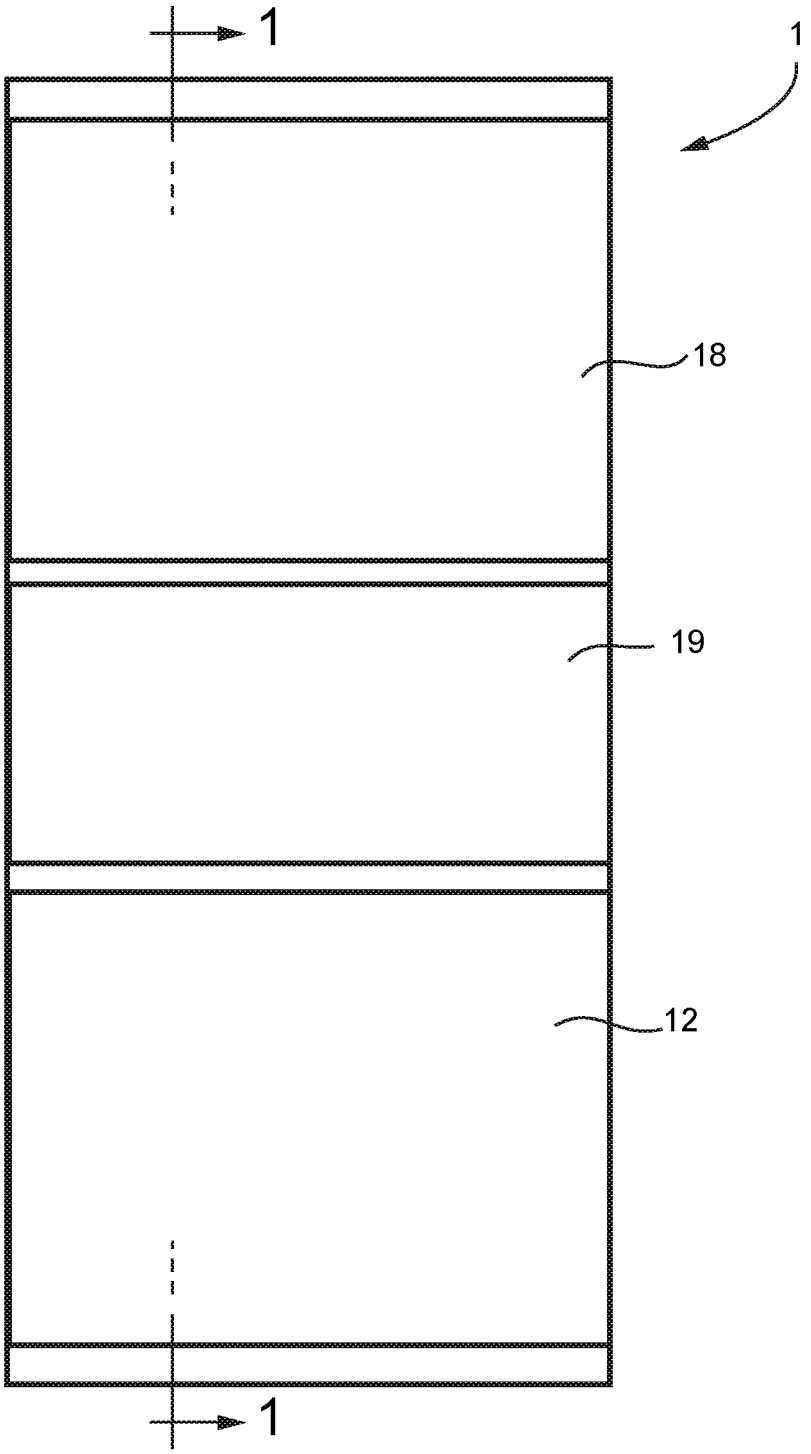
Figure 6:
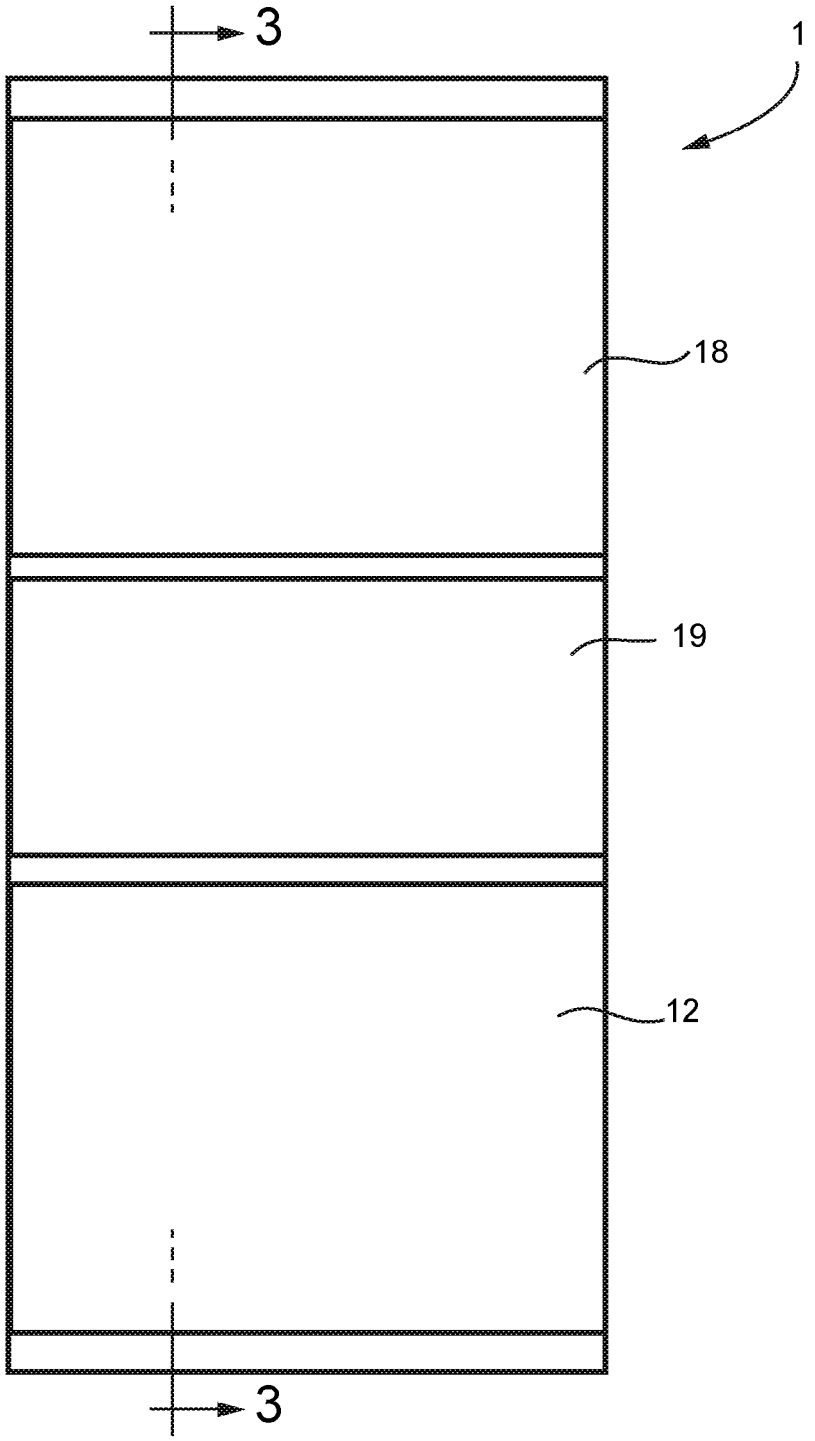

The invention will be described in greater detail hereafter, by way of non-limiting examples, with reference to the embodiments shown in the drawings, wherein FIG. 1 is a cross-sectional view of a domestic refrigerator taken through line 1-1 of FIG. 5, FIG. 2 is a front view of the refrigerator, FIG. 3 is a cross-sectional view of an alternative domestic refrigerator taken through line 3-3 of FIG. 6, FIG. 4 is a front view of the alternative refrigerator, FIG. 5 is a front view of the refrigerator, and FIG. 6 is a front view of the refrigerator.

FIG. 1 shows a side and cutaway view of a domestic refrigerator 1, i.e. a refrigerator intended to be used as a home appliance. FIG. 2 shows a front view of the refrigerator 1.

The refrigerator 1 of FIG. 1 comprises a refrigerator cabinet or housing 2. Disposed within the lower part of the refrigerator housing 2 is a freezer compartment 3 and disposed within the upper part of the housing 2 is a fresh-food compartment 4. In between the freezer compartment 3 and the fresh-food compartment 4 is a cold storage compartment 5 disposed within the housing 2. The housing 2 comprises thermally insulated walls, in particular a rear wall 6, two side walls 7, a bottom wall 8 and a ceiling wall 9, and a fixed divisional wall 10 separating the freezer compartment 3 from the cold storage compartment 5. Thus, the surface of the fixed divisional wall 10 directed downwards is the ceiling of the freezer compartment 3 and the surface of the divisional wall 10 facing upwards is the bottom of the cold storage compartment 3. The divisional wall 10 separating the freezer compartment 3 and the cold storage compartment 4 is an integrated part of the housing 2. The housing was particularly manufactured utilizing a foaming process as it is generally known in the art.

The refrigerator 1 further comprises at least one refrigerant circuit for cooling the freezer, fresh food and cold storage compartments 3, 4, 5. There may be a dedicated refrigerant circuit for the freezer compartment 3 and another refrigerant circuit for both, the cold and the fresh food compartments 4, 5. Each refrigerant circuit comprises, as it is generally known in the art, a compressor, a condenser and an evaporator. The compressors are, for instance, disposed within a mechanical compartment 11 located behind the freezer compartment 3. It is also possible that the refrigerant circuits share a common compressor.

The refrigerator 1 further comprises a control which is designed to control the refrigerant circuits such that the actual temperatures of the freezer, cold storage and fresh food compartments 3, 4, 5 are at least about a target temperature. In order to achieve this, the control may include an appropriate control feedback and temperature sensors designed to estimate the actual temperatures of the freezer, cold storage and fresh food compartments 3, 4, 5 as it is generally known in the art. The temperature sensors are connected to the control and are nor shown in the figures.

The refrigerator 1 further comprises a thermally insulated door leaf 12 for opening and closing the freezer compartment 3 and several drawers 13 disposed on top of each other within the freezer compartment 3. The drawers 13 are intended to store frozen food and can be at least partly pulled out from the freezer compartment 3 when the door leaf 12 of the freezer compartment 3 is open. The freezer compartment 3 can be cooled down to sub-zero degrees centigrade, in particular to temperatures around −18° C. The door leaf 12 of the freezer compartment 3 is hinged by appropriate hinges 14, 15 to the housing 2. Particularly, one of the hinges 14 for the freezer compartment door leaf 12 is fixed to the bottom wall 8 and the other hinge 15 is fixed at least partly to the divisional wall 10 as it can be seen in FIG. 2 which shows the refrigerator 1 without the freezer compartment door leaf 12. For the example shown, the hinge 15 is also partly fixed to the relevant of the two side walls 7. the In addition, there is a gasket 16 attached to the inner surface of the freezer compartment door leaf 12 for sealing purpose as it is commonly known in the art.

The refrigerator 1 shown as an example in FIGS. 1 and 2 further comprises a divisional wall 17 which is in particular thermally insulated and is intended to separate the cold storage compartment 5 from the fresh food compartment 4. This divisional wall 17 is not an integrated part of the housing 2, i.e. was not integrated into the housing 2 during the foaming process. This divisional wall 10, which extends approximately to the rear wall 6 of the housing 2, was mounted or attached to the housing 2 after its foaming. The divisional wall 17 may be fixed to the side walls 7 by appropriate fixing or attaching means, such as latching devices 34. The divisional wall 17 may be permanently fixed to the housing 2 or me be detachably mounted to the housing 2. If detachably mounted to the housing, the attaching means may be configured such that the divisional wall 17 can only be detached from the housing 2 utilizing an appropriate tool. Then, only a service personal for the refrigerator 1 may be able to remove the divisional wall 17. It is also possible to design the attaching means such that the user of the refrigerator 1 can detach the divisional wall 17 from the housing 2.

In particular, the divisional wall 17 separating the cold storage compartment 5 from the fresh food compartment 4 was inserted into the housing 2 after of its foaming. Therefore, the divisional wall 17 separating the cold storage compartment 5 from the fresh food compartment 4 was assembled after foaming the housing 2 of the refrigerator 1.

The refrigerator 1 further comprises a door leaf 18 for opening and closing the fresh food compartment 4 and a separate door leaf 19 for opening and closing the cold storage compartment 5. These two door leafs 18, 19 are thermally insulated and are hinged to the housing 2 and to the divisional wall 17 on top of each other.

In addition, the refrigerator 1 shown as an example in FIGS. 1 and 2 comprises several shelves 20 disposed on top of each other within the fresh food compartment 4 and several door shelves 21 arranged on the surface of the fresh food compartment door leaf 18 facing towards the fresh food compartment 4. The shelves 20 and the door shelves 21 are intended to store fresh food and can be reached when the fresh food compartment door leaf 18 is open. The fresh compartment 4 can be cooled down to temperature above zero degrees Centigrade, in particular to temperatures around +3° C. to +8° C.

In addition, the refrigerator 1 shown as an example in FIGS. 1 and 2 comprises several drawers 22 disposed on top of each other within the cold storage compartment 5. The drawers 22 are intended to store fresh food, particularly vegetables and fruits at non-freezing temperatures around 0° C. Particularly, the cold storage compartment 5 is intended to provide non-freezing temperatures in the range between 0° C. and 3° C. The drawers 22 can be pulled out from the cold storage compartment 5 when the cold storage compartment door leaf 19 is open.

As discussed above, the fresh food and the cold storage door leafs 18, 19 are hinged by appropriate hinges to the housing 2 and to the divisional wall 17 separating the cold storage compartment 5 from the fresh food compartment 4. In particular, there is one hinge 23 fixed to the ceiling wall 9 and another hinge 24 fixed at least partly to the divisional wall 17 separating the cold storage compartment 5 from the fresh food compartment 4, and one hinge 25 fixed at least partly to the divisional wall 10 separating the cold storage compartment 5 from the fresh food compartment 4 and another hinge 26 fixed at least partly to the divisional wall 10 separating the cold storage compartment 5 from the freezer compartment 5, as it is illustrated by FIG. 2 which shows the refrigerator 1 without the door leafs 12, 18, 19. For the example shown, the hinges 24, 25 are also partly fixed to the relevant of the two side walls 7. The hinges 24, 25 can be designed as two separate parts or as a single part. The same can apply to the hinges 15, 26.

In addition, the fresh food and the cold storage compartment door leafs 18, 19 are equipped with sealing gaskets 27, 28 attached to the surfaces of the door leafs 18, 19 facing toward the cold storage and fresh food compartments 4, 5. In order to improve the sealing capabilities, the gaskets 27, 28 may be provided with magnets, as it is generally known in the art. The housing 2 and particularly the divisional wall 17 separating the cold storage compartment 5 from the fresh food compartment 4 may comprise appropriate metallic contacts for the door leaf gasket magnets. In particular, the edge of the divisional wall 17 which separates the cold storage compartment 5 from the fresh food compartment 4 and which faces towards the appropriate door leafs 18, 19 may be covered by a metallic sheet. This may also improve stability for the door leaf hinges 27, 28.

As discussed above, the cold storage and the fresh food compartments 4, 5 of the refrigerator 1 shown in FIGS. 1 and 2 share a common refrigerant cycle. In particular, the evaporator 29 of this cooling cycle is thermally coupled to the cold storage compartment 5. For the example shown, the evaporator 29 is located into a housing 30 which is attached to the surface of the rear wall 6 facing towards the cold storage compartment 5. Within this housing 30, at least one fan may be provided configured to convey air cooled by the evaporator 29 into the cold storage compartment 5. As a result, for the example refrigerator 1 shown in FIGS. 1 and 2, there is no evaporator provided to cool directly and independently the fresh food compartment 5 from the cold storage compartment 4. In fact, the fresh food compartment 4 is cooled utilizing cold air from the cold storage compartment 5.

In order to allow exchange of air between the cold storage and the fresh food compartments 5, 4, the refrigerator 1 comprises an air channel system connecting the cold storage compartment 5 with the fresh food compartment 4. Particularly for the example refrigerator 1, there is an air channel 31 attached to the surface of the rear wall 6 of the housing 2 facing towards the fresh food compartment 4. The air channel 29, for instance, extends almost to the ceiling wall 9 and is connected to the housing 30 which holds the evaporator 29. The divisional wall 17 may, as it is shown in FIG. 1, extends to the air channel 31. It is also possible that the air channel 31 is disposed within the rear wall 6 or that there is a gap between the divisional wall 17 and the rear wall 6 of the housing 2.

In order to allow circulation of the air between the cold storage compartment 5 and the fresh food compartment 4, the divisional wall 17 comprises at least one opening or an air channel 32 which is or are located close to the end of the divisional wall 17 facing turned away from the rear wall 6. In particular, the at least one opening or air channel 32 of the divisional wall 17 is or are located behind the area of the gaskets 27, 28 attached to the fresh food and cold storage compartment door leafs 18, 19. Particularly, the air channel 32 extends essentially about the entire width of the divisional wall 17, i.e. essentially from one side wall 7 of the housing 2 to the other. Particularly, the air channel 32 runs parallel to the rear wall 6 of the housing 2. The direction of the air flow between the cold storage and the fresh food compartments is illustrated by arrows 33. If the refrigerator 1 comprises the fan associated with the evaporator 29, then the air flow may be supported by this fan.

Additionally, the divisional wall 17 separating the cold storage compartment 5 from the fresh food compartment 4 may comprise at least one reinforcement component, such as at least one metal stamping part in order, for instance, to improve rigidity of the divisional wall 17.

The divisional wall 17 separating the cold storage compartment 5 from the fresh food compartment 4 may comprise an upper plastic injection molded part which forms its visible and touchable top surface. This surface is also the bottom of the fresh food compartment 4. This surface may comprise means to form the at least one opening or the at least one channel 32 within the divisional wall 17.

The divisional wall 17 separating the cold storage compartment 5 from the fresh food compartment 4 may comprise a lower plastic injection molded part which forms its visible and touchable bottom surface. This surface is also the ceiling of the cold storage compartment 5. This surface may comprise means to form the at least one opening or the at least one channel 32 within the divisional wall 17.

The divisional wall 17 separating the cold storage compartment 5 from the fresh food compartment 4 may comprise a thermally insulating part, for instance, made from expanded polystyrene or a foam material, for improving thermal insulation between the cold storage compartment 5 and the fresh food compartment 4. The insulating part may also enhance the stability of the divisional wall 17.

FIG. 3 shows a side and a cutaway view of a further domestic refrigerator 41 and FIG. 2 shows a front view of this refrigerator 41. If not otherwise indicated, then the parts of the refrigerator 1 of FIGS. 1 and 2, which are essentially structurally and functionally identical to those of the refrigerator 41 of FIGS. 3 and 4, are denoted with the same reference signs.

The refrigerators 1 and 41 differ essentially in their divisional walls separating the cold storage compartment 5 from the fresh food compartment 4. The divisional wall separating the cold storage compartment 5 from the fresh food compartment 4 of the refrigerator 41 is denoted by the reference sign 42.

While the divisional wall 17 separating the cold storage compartment 5 from the fresh food compartment 4 of the refrigerator 1 depicted in FIGS. 1 and 2 essentially forms one piece, the divisional wall 42 separating the cold storage compartment 5 from the fresh food compartment 4 of the refrigerator 41 shown in FIGS. 3 and 4 essentially comprises two pieces, a main part 43 an a traverse 44.

The traverse 44 is fastened to the housing 2 and connects both its side walls 4 at the side of the housing 2 averted from the rear wall 6. The traverse 44 includes at least partly the hinges 24, 25 for the fresh food and cold storage compartment door leafs 18, 19. The traverse 44 of the divisional wall 41 may comprise appropriate metallic contacts for the door leaf gasket magnets. In particular, the edge of the traverse 44 which faces towards the appropriate door leafs 18, 19 may be covered by a metallic sheet.

The main part 43 of the divisional wall 42 of the refrigerator 41 extends from the rear wall 6 of the housing 2, particularly from the air channel 31 to the traverse 44 and comprises the air channel 32 similar to the divisional wall 17 of the refrigerator 1. This air channel 32 may alternatively be formed by a gap between the main part 43 and the traverse 44.

The main part 43 of the divisional wall 42 forms basically the bottom of the fresh food compartment 4 and the ceiling of the cold storage compartment 5.

The main part 43 of the divisional wall 42 may comprise at least one reinforcement component, such as at least one metal stamping part in order, for instance, to improve the rigidity of the divisional wall 42.

The main part 43 of the divisional wall 42 may comprise an upper plastic injection molded part which forms its visible and touchable top surface. This surface is also the bottom of the fresh food compartment 4. This surface may comprise means to form the at least one opening or the at least one channel 32 within the main part 43 of the divisional wall 42.

The main part 43 of the divisional wall 42 may comprise a lower plastic injection molded part which forms its visible and touchable bottom surface. This surface is also the ceiling of the cold storage compartment 5. This surface may comprise means to form the at least one opening or the at least one channel 32 within the main part 43 of the divisional wall 42.

The main part 43 of the divisional wall 42 may comprise a thermally insulating part, for instance, made from expanded polystyrene or a foam material, for improving thermal insulation between the cold storage compartment 5 and the fresh food compartment 4. The insulating part may also enhance the stability of the divisional wall 42.

The traverse 44 may also include a heating system, for instance, comprised of a heating tube 45, which heating system is intended to at least reduce the risk of generated dew. The heating tube 45 particularly is a hot gas tube connected to the refrigerant circuit.

LIST OF REFERENCE SIGNS

1 refrigerator
2 housing
3 freezer compartment
4 fresh-food compartment
5 cold storage compartment
6 rear wall
7 side walls
8 bottom wall
9 ceiling wall
10 divisional wall
11 mechanical compartment
12 door leaf
13 drawers
14, 15 hinge
16 gasket
17 divisional wall
18, 19 door leaf
20 shelves
21 door shelves
22 drawers
23-26 hinge
27, 28 gaskets
29 evaporator
30 housing
31, 32 air channel
33 arrows
34 latching device
41 refrigerator
42 divisional wall
43 main part
44 traverse
45 heating tube

The invention claimed is:

1. A domestic refrigerator, the domestic refrigerator comprising:

a thermally insulated housing;

a cold storage compartment;

a fresh food compartment contained within the thermally insulated housing such that the fresh food compartment is located on top of the cold storage compartment;

a single refrigerant circuit which comprises a single evaporator configured to directly cool only the cold storage compartment;

a first door leaf configured to close and open the fresh food;

a second door leaf configured to close and open the cold storage compartment;

a divisional wall separately attachable to the housing and separating the cold storage compartment from the fresh food compartment; and an air channel system configured to allow an air exchange between the cold storage compartment and the fresh food compartment, wherein the domestic refrigerator further comprises a freezer compartment disposed below the cold storage compartment, wherein the freezer compartment comprises a second refrigerant circuit configured to cool the freezer compartment independently of the cold storage compartment and the fresh food compartment.

2. The domestic refrigerator of claim 1, wherein at least one of the first door leaf and the second door leaf comprises a magnetic gasket attached on a surface facing towards the cold storage compartment or the fresh food compartment, respectively, and an edge of the divisional wall facing away from the cold storage compartment and the fresh food compartment comprises or is made at least partly from a metal.

3. The domestic refrigerator of claim 1, wherein the first door leaf and the second door leaf are connected to the thermally insulated housing by hinges, at least one of the hinges being at least partly attached to an edge of the divisional wall facing away from the cold storage compartment and the fresh food compartment.

4. The domestic refrigerator of claim 1, wherein the divisional wall or at least a main part of the divisional wall is inserted into and attached to the thermally insulated housing.

5. The domestic refrigerator of claim 4, wherein the divisional wall or at least the main part of the divisional wall is attached to the thermally insulated housing by latching devices.

6. The domestic refrigerator of claim 4, wherein the divisional wall or at least the main part of the divisional wall is configured to be detached from the thermally insulated housing only by a tool.

7. The domestic refrigerator of claim 4, wherein the divisional wall or at least the main part of the divisional wall is configured to be detached from the thermally insulated housing without any tools.

8. The domestic refrigerator of claim 4, wherein the divisional wall comprises the main part, which is inserted into and attached to the thermally insulated housing, and wherein the divisional wall comprises a traverse which is rigidly fixed to and at a front side of the thermally insulated housing, and runs between side walls of the thermally insulated housing.

9. The domestic refrigerator of claim 8, wherein at least one hinge is at least partly attached to an edge of the traverse facing away from the cold storage compartment and the fresh food compartment.

10. The domestic refrigerator of claim 1, wherein the divisional wall or at least the main part of the divisional wall comprises at least one aperture or air channel which forms at least a part of the air channel system.

11. The domestic refrigerator of claim 10, wherein the at least one aperture or the air channel is located near a front side of the domestic refrigerator, essentially extends about the entire width of the divisional wall, and/or runs parallel to a rear wall of the housing.

12. The domestic refrigerator of claim 1, wherein the air channel system comprises an air channel, the air channel connecting the cold storage compartment with the fresh food compartment.

13. The domestic refrigerator of claim 12, wherein the air channel is located inside a rear wall of the housing, is attached to a surface of the rear wall of the housing facing towards the cold storage compartment and the fresh food compartment, or is formed by a gap between the divisional wall and the surface of the rear wall of the thermally insulated housing facing towards the cold storage compartment and the fresh food compartment.

14. The domestic refrigerator of claim 13, wherein the air channel extends to at least half of a height of the fresh food compartment.

15. The domestic refrigerator of claim 1, wherein the divisional wall comprises at least one reinforcement component, wherein the divisional wall comprises a thermally insulating part or is made from a thermally insulating material, and wherein the divisional wall comprises a heating system and/or a heating tube connected to the single refrigerant circuit.

16. The domestic refrigerator of claim 1, wherein the single evaporator is disposed within the cold storage compartment.

17. The domestic refrigerator of claim 1, wherein at least a portion of the air channel system is disposed at least partially directly between a wall of the thermally insulated housing and the divisional wall.

18. The domestic refrigerator of claim 1, wherein the fresh food compartment is only cooled by air from the cold storage compartment.

* * * * *